US005570853A

United States Patent [19]

Teng

[11] Patent Number: 5,570,853

[45] Date of Patent: Nov. 5, 1996

[54] RELEASABLE CABLE HOLDER ASSEMBLY FOR WINDING MACHINES

[75] Inventor: Kui-Yu Teng, Chung Ho, Taiwan

[73] Assignee: U Gear Automatic Machinery Co., Ltd., Taipei Hsien, Taiwan

[21] Appl. No.: 528,227

[22] Filed: Sep. 14, 1995

[51] Int. Cl.[6] ..... B21C 47/24; B65H 54/56; B65H 49/30; B65H 49/20

[52] U.S. Cl. ..... 242/362.2; 242/53; 242/127; 242/129; 242/533; 242/570; 242/597.5

[58] Field of Search ..... 242/53, 127, 129, 242/533, 537, 573.7, 597.5, 362–362.3, 572, 570, 576.1, 577, 577.2, 361.3, 363

[56] References Cited

U.S. PATENT DOCUMENTS

| | | | |
|---|---|---|---|
| 235,359 | 12/1880 | Hewitt et al. | 242/362.3 |
| 2,135,913 | 11/1938 | Ralston et al. | 242/362.3 |
| 3,480,219 | 11/1969 | Hanscom | 242/53 |
| 3,971,525 | 7/1976 | Winslow | 242/53 X |
| 4,411,394 | 10/1983 | Starvaski et al. | 242/362.2 |

*Primary Examiner*—Daniel P. Stodola
*Assistant Examiner*—Michael R. Mansen
*Attorney, Agent, or Firm*—Bacon & Thomas

[57] ABSTRACT

A releasable cable holder assembly including pairs of pawl devices mounted on the winding wheel of a winding machine for winding a cable, and a knock-out control mechanism controlled to release the pawl devices from the finished winding of cable, wherein each pawl device includes a front holder plate and a rear holder plate fastened in an elongated slot on the winding wheel at two opposite sides, a spring-supported pawl fastened to a respective L-shaped through hole on each holder plate, and two wheels mounted in the L-shaped through holes of the holder plates at different elevations and disposed in contact with the spring-supported pawl at two opposite sides for guiding the pawl into a tilted position to release the winding of cable when the pawl devices are forced forwards by the knock-out control mechanism.

5 Claims, 6 Drawing Sheets

RELEASABLE CABLE HOLDER ASSEMBLY FOR WINDING MACHINES

BACKGROUND OF THE INVENTION

The present invention relates to a releasable cable holder assembly for winding machines which comprises a plurality of pawl devices for winding a cable, and a knock-out control device for tiling the pawl devices for permitting the finished winding of cable to be removed from the pawl devices.

When a cable is fabricated, it must be arranged into a winding so that it can be conveniently delivered to the desired place. Conventionally, a winding machine for this purpose is generally comprised of a rotary table revolvably mounted on a support, and a plurality of steel rods perpendicularly fastened to the rotary table for winding a cable. When the winding of cable is finished, it must be pulled out of the steel rods by force. When the winding of cable is pulled out of the steel rods, the insulator of the cable tends to be damaged. If the steel rods are obliquely fastened to the rotary wheel to slope inwards, the finished winding of cable can be conveniently removed from the steel rods. However, this arrangement confines the finished winding of cable to a conical shape, which will move out of course when rolled on the ground. Sleeves may be used and mounted on the steel rods of the rotary wheel for winding a cable. When the winding is finished, the winding of cable and the sleeves can be simultaneously removed from the steel rods. However, much time will be wasted in loading and unloading the sleeves. FIG. 1 shows a releasable cable holder for winding machines which permits the finished winding of cable to be conveniently removed from the winding machine. This releasable cable holder comprises a pawl holder 1', a pawl 2' movable coupled to the pawl holder 1' between two wheels 14 and 14', and a return spring 21 connected between a rod 13 on the pawl holder 1' and the beveled rear end 23 of the pawl. The pawl 2' has an oblong slot 22 near the beveled rear end 23 and loosely coupled to a locating pin 15 on the pawl holder 1'. This releasable cable holder is functional, however it is not durable in use because the return spring tends to be damaged.

SUMMARY OF THE INVENTION

The present invention has been accomplished to provide a releasable cable holder assembly which eliminates the aforesaid drawbacks. According to the present invention, the releasable cable holder assembly comprises pairs of pawl devices mounted on the winding wheel of a winding machine for winding a cable, a knock-out control mechanism controlled to release the pawl devices from the finished winding of cable, and a cable chuck installed in the winding wheel of the winding machine for holding the lead end of the cable to be wound, wherein each pawl device comprises a front holder plate and a rear holder plate fastened in an elongated slot on the winding wheel at two opposite sides, a spring-supported pawl fastened to a respective L-shaped through hole on each holder plate, and two wheels mounted in the L-shaped through holes of the holder plates at different elevations and disposed in contact with the spring-supported pawl at two opposite sides for guiding the pawl into a tilted position to release the winding of cable when the pawl devices are forced forwards by the knock-out control mechanism. According to the present invention, the releasable cable holder assembly achieves the following advantages:

(1) The finished winding of cable has a nice looking. Because the retaining rods of the pawls of the pawl devices are disposed perpendicular to the winding wheel during the winding operation, the cable is wound in good order.

(2) The releasable cable holder assembly does not damage the cable. Because the retaining rods of the pawls of the pawl devices are tilted inwards from the finished winding of cable, the finished winding of cable will not rub against the pawls of the pawl devices when it is unloaded.

(3) The retaining rods of the pawls of the pawl devices are automatically returned to their former positions perpendicular to the winding wheel when the finished winding of cable is removed.

(4) The design of the knock-out control mechanism permits the pneumatic cylinders to be synchronously operated to force the pressure disk against the pawl devices after the finishing of the winding, so that the finished winding of cable can be immediately removed from the winding machine.

(5) The installation of the cable chuck permits the lead end of the cable to be kept in place during the winding operation.

DETAILED DESCRIPTION OF THE PREFERRED EMBODIMENT

Figure 1:
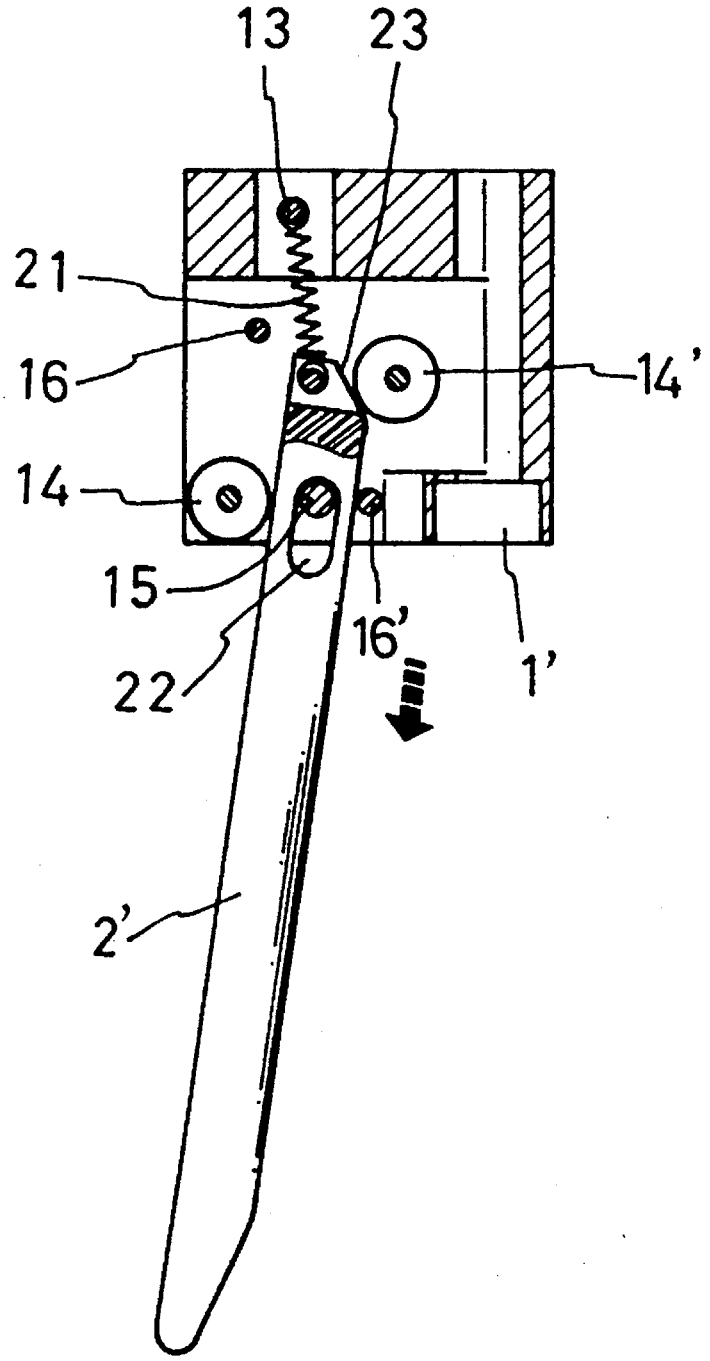
FIG.1 (PRIOR ART)
FIG. 1 shows a releasable cable holder for winding machines according to the prior art.
Figure 2:
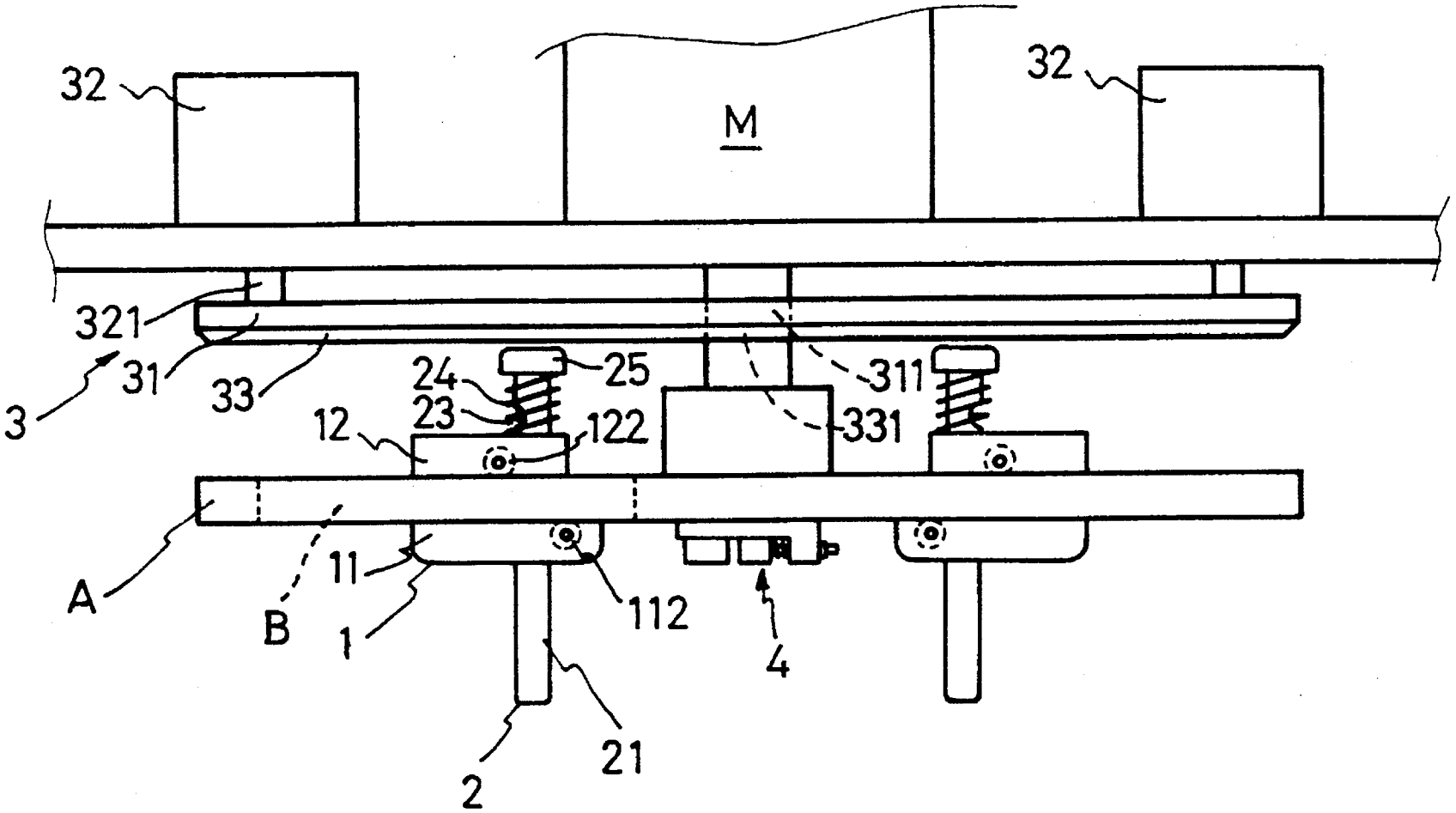
FIG. 2 is a top view showing a releasable cable holder assembly installed in a winding machine according to the present invention.
Figure 3:
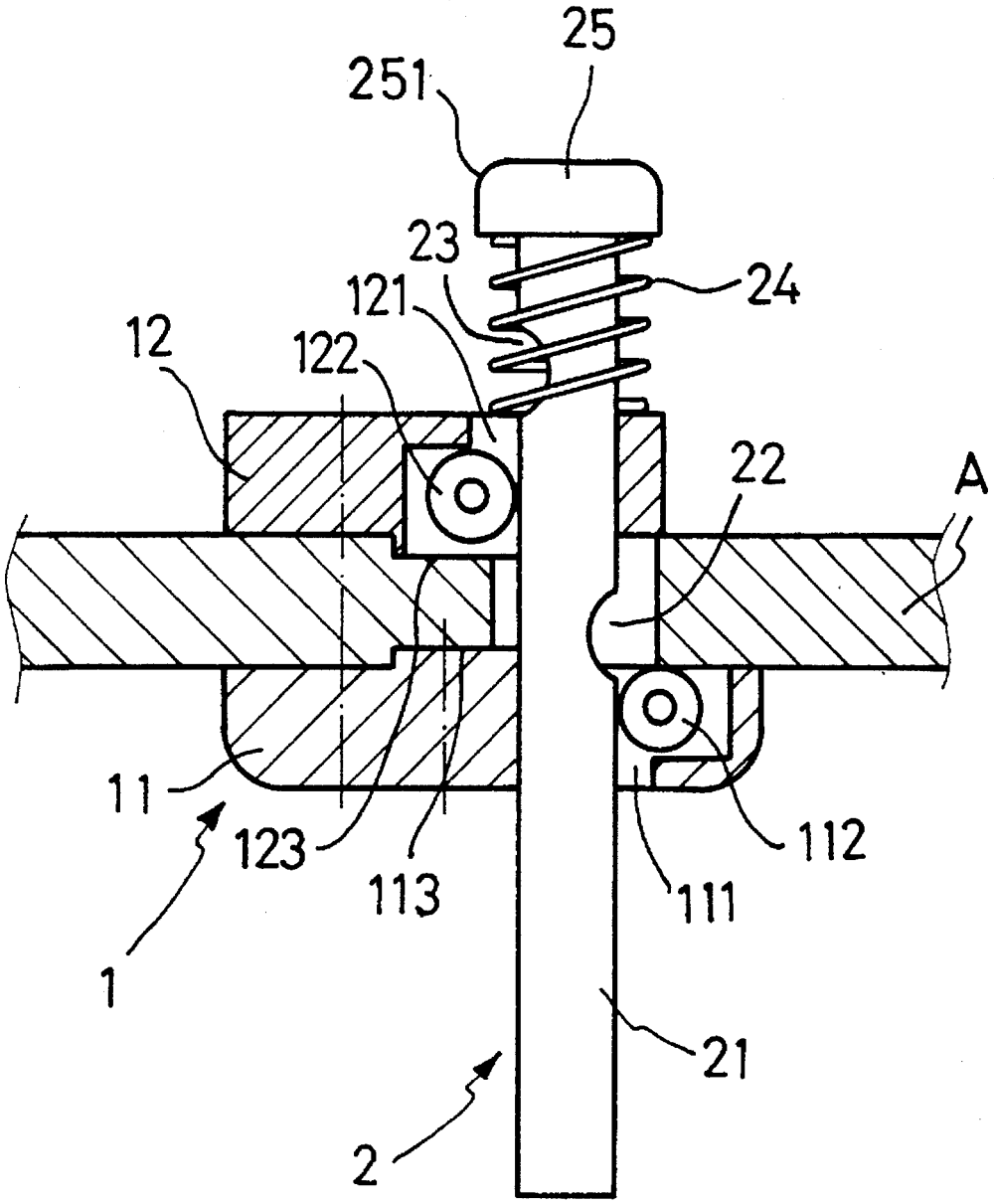
FIG. 3 is a sectional view in an enlarged scale of a pawl device according to the present invention.

Referring to FIGS. 2 and 3, pairs of pawl devices are installed in the winding machine for winding a cable, each pawl device comprised of a pawl holder 1, and a pawl 2. The pawl holder 1 consists of a front holder plate 11 and a rear holder plate 12. The front holder plate 11 and the rear holder plate 12 are fastened to an elongated slot B on a winding wheel A at two opposite sides. Each holder plate 11 or 12 has a respective L-shaped through hole 111 or 121 for passing one pawl 2, and a respective wheel 112 or 122 inside the L-shaped through hole 111 or 121. The wheels 112 and 122 of the holder plates 11 and 12 are disposed in contact with the corresponding pawl 2 at two opposite sides. The holder plate 11 or 12 further comprises a stop block 113 or 123 at an inner side moved in the elongated slot B. The pawl 2 comprises an elongated retaining rod 21 having a first arched recess 22 and a second arched recess 23 corresponding to the wheels 112 and 122 of the holder plates 11 and 12, a cap 25 at one end of the retaining rod 21, a spring 24 mounted around the retaining rod 21 and stopped between the cap 25 and the rear holder plate 12. The cap 25 has a chamfered periphery 251, which minimizes friction resistance when the cap 25 is moved.

Figure 5:
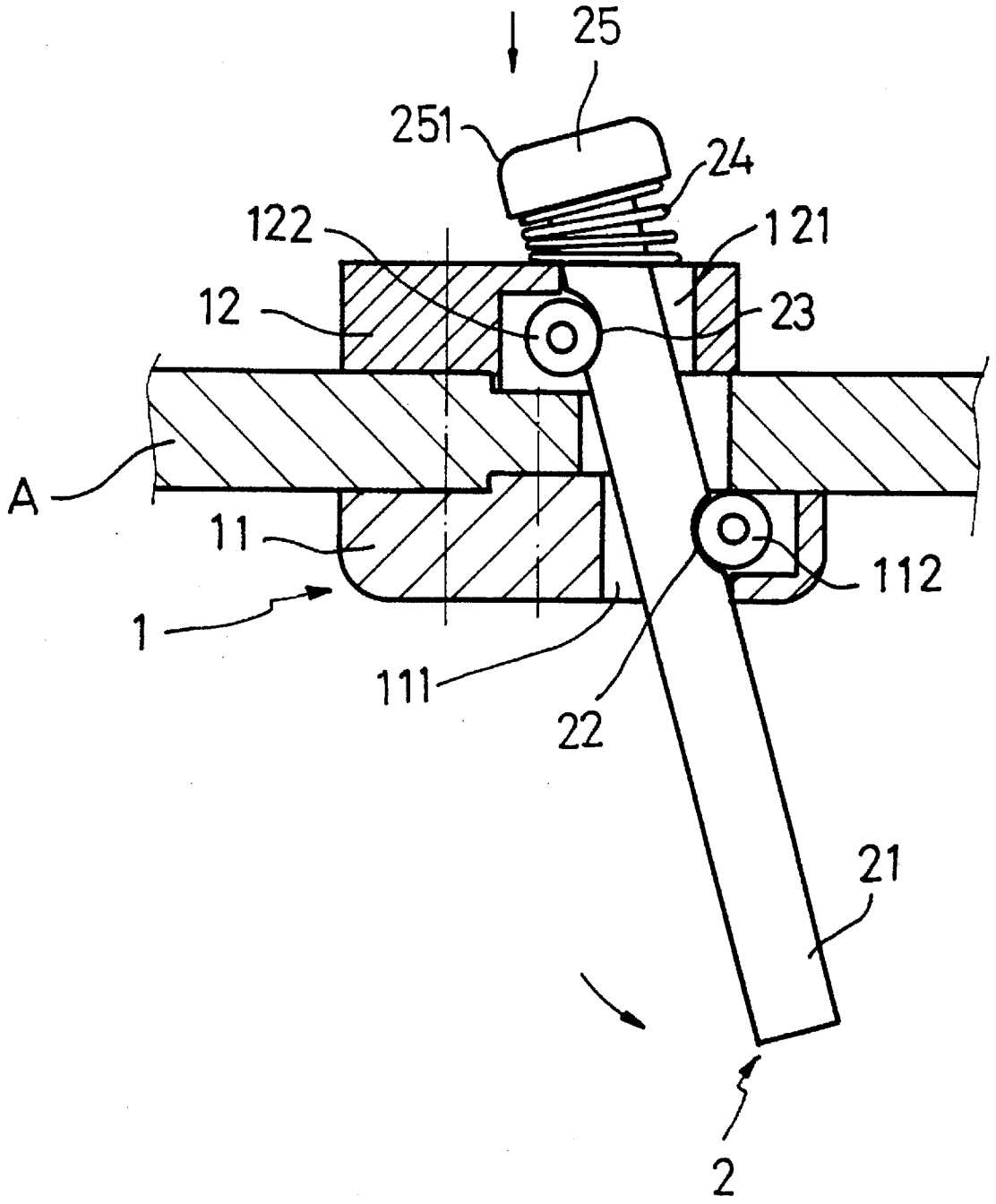
FIG. 5 is similar to FIG. 3 but showing the retaining rod tilted.

Referring to FIG. 5, after winding, the cap 25 is forced to move the retaining rod 21 forwards, causing the spring 24 compressed. During the forward stroke of the retaining rod 21, the first arched recess 22 is forced into engagement with the wheel 112. Because the diameter of the through holes 111 and 121 are relatively bigger than that of the retaining rod 21, continuously forcing the retaining rod 21 forwards causes the retaining rod 21 to tilt inwards from the winding of cable, for permitting the winding of cable to be removed from the cable holder. When the forward pressure is released from the cap 25, the spring 24 immediately forces the cap 25 back to its former position, and therefore the pawl 2 is returned to its former position perpendicular to the winding machine for further winding operation.

Figure 4:
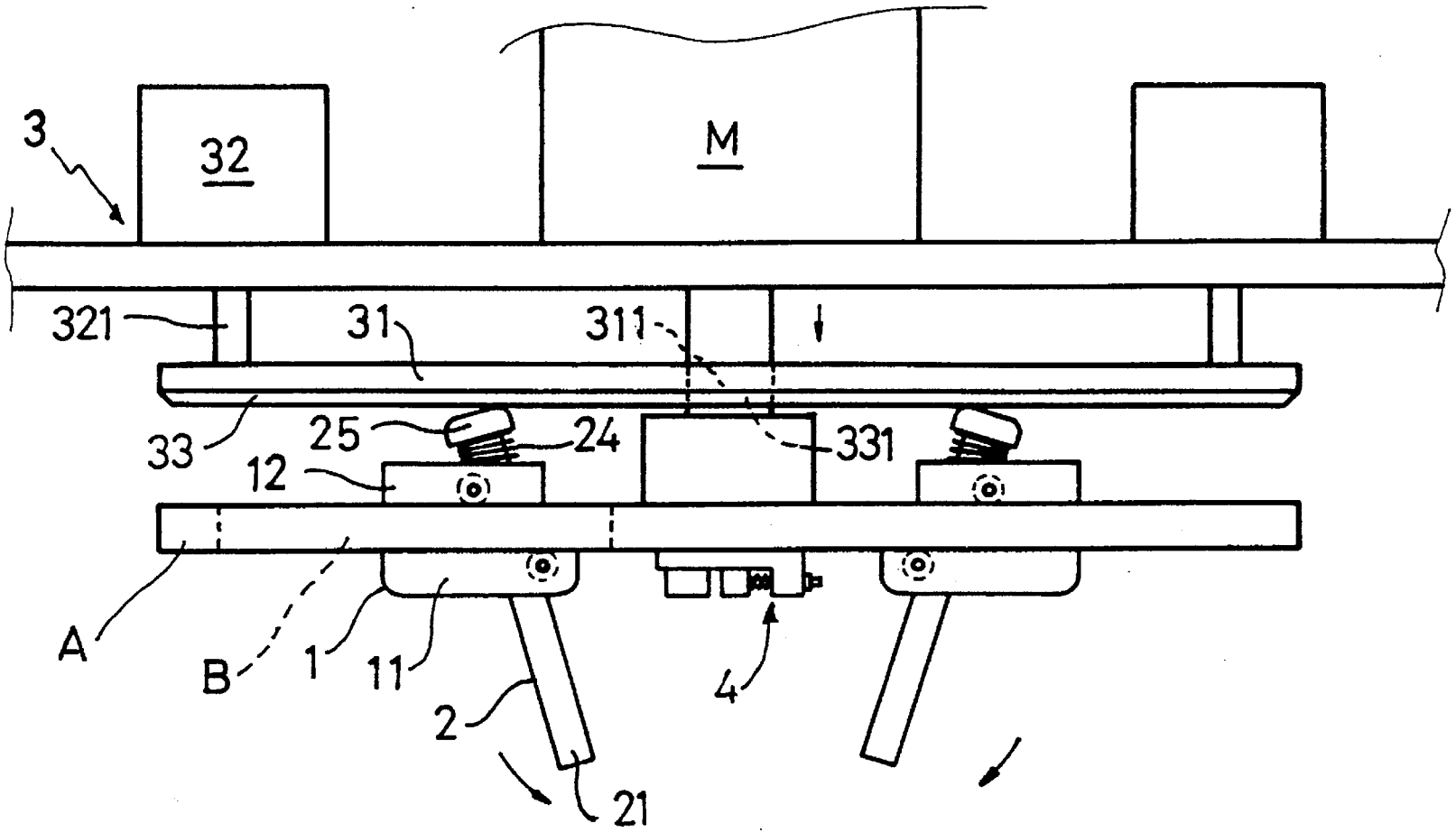
FIG. 4 is similar to FIG. 2 but showing the retaining rods of the pawl devices tilted.

Referring to FIG. 2, a knock-out control mechanism 3 is disposed behind the releasable cable holder, and controlled to give a forward pressure to the cap 25 of each pawl 2. The knock-out control mechanism 3 comprises a pressure disk 31 having a center hole 311 for passing the motor shaft of the motor M of the winding machine for permitting the motor shaft of the motor M to be fixedly secured to the winding wheel A, and two pneumatic cylinders 32 disposed at two opposite sides relative to the motor M and having a respective piston rod 321 respectively perpendicularly coupled to the pressure disk 31. When the pneumatic cylinders 32 are controlled to extend out the piston rods 321, the pressure disk 31 is moved forwards to force the cap 25 of each pawl 2 (see FIG. 4) forwards. Therefore, the pawls 2 of the releasable cable holder are tilted for allowing the winding of cable to be removed from the winding machine. Furthermore, a high polymer cushion 33 is covered on the pressure disk 31 at the front side, having a center hole 331 aligned with the center hole 311 of the pressure disk 31 for passing the motor shaft of the motor M.

Figure 6:
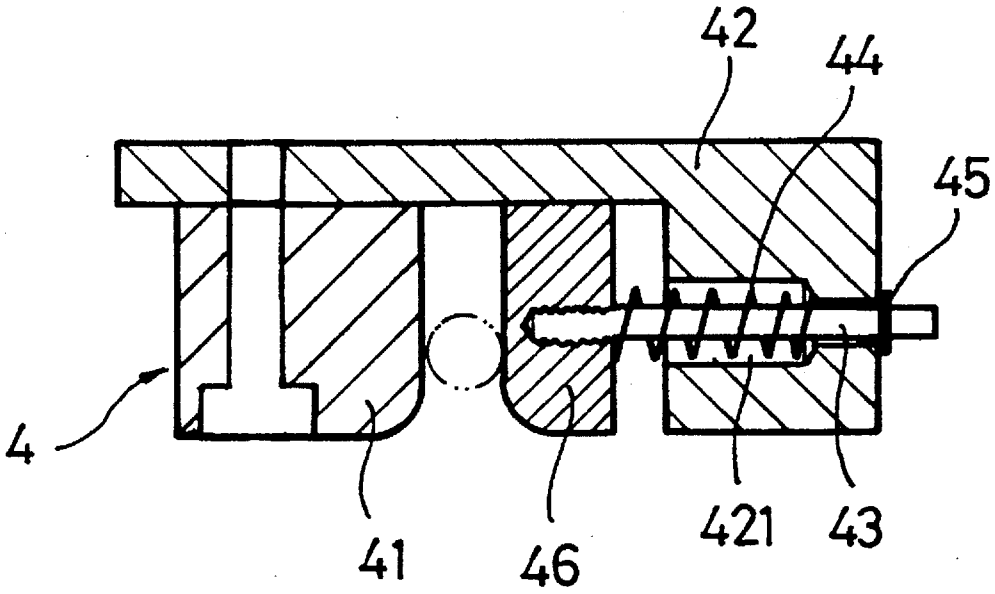
FIG. 6 is a sectional view of a cable chuck according to the present invention.

Referring to FIGS. 2 and 6, a cable chuck 4 is mounted on the winding wheel A for holding the lead end of the cable under winding. The cable chuck 4 comprises a locating plate 42 having a transverse hole 421, a fixed vertical jaw 41 fixedly fastened to the locating plate 42, a pin 43 fixed to the transverse hole 421 by a clamp 45, a movable jaw 46 loosely coupled to the pin 43 and moved relative to the fixed jaw 41, and a spring 44 mounted around the pin 43 and stopped between the movable jaw 46 and the inside wall of the transverse hole 421. The spring 44 constantly forces the movable jaw 46 toward the fixed jaw 4. Therefore, when the movable jaw 46 is moved backwards to compress the spring 44, the lead end of the cable can be inserted in between the fixed jaw 41 and the movable jaw 46. When the movable jaw 46 is released, the spring 44 forces the movable jaw 46 forwards, causing the lead end of the cable firmly retained between the fixed jaw 41 and the movable jaw 46.

It is to be understood that the drawings are designed for purposes of illustration only, and are not intended as a definition of the limits and scope of the invention disclosed.

I claim:

1. A releasable cable holder assembly comprising pairs of pawl devices mounted on a winding wheel of a winding machine for winding a cable, and a knock-out control mechanism controlled to release said pawl devices from the finished winding of cable, wherein each pawl device is comprised of a pawl holder and a pawl, said pawl holder consisting of a front holder plate and a rear holder plate respectively fastened to said winding wheel in an elongated slot therein at two opposite sides and having a respective L-shaped through hole for passing said pawl and a respective wheel inside the respective L-shaped through hole, the wheels of said front and rear holder plates being disposed in contact with said pawl at two opposite sides, said front and rear holder plates each having a stop block at an inner side disposed in said elongated slot, said pawl comprising an elongated retaining rod having a first arched recess and a second arched recess corresponding to the wheels of said front and rear holder plates, a cap at one end of said retaining rod, a spring mounted around said retaining rod and stopped between said cap and said rear holder plate, said retaining rod being tilted inwards from the winding of cable when said cap is forced forward by said knock-out control mechanism.

2. The releasable cable holder assembly of claim 1 wherein the cap of each pawl has a chamfered periphery.

3. The releasable cable holder assembly of claim 1 wherein said knock-out control mechanism comprises a pressure disk having a center hole for passing the motor shaft of a motor of the winding machine and being moved to press against the caps of the pawls of said pawl devices, and two pneumatic cylinders bilaterally coupled to said pressure disk and controlled to reciprocate said pressure disk relative to the caps of the pawls of said pawl devices.

4. The releasable cable holder assembly of claim 1 wherein said pressure disk has a front side facing the cap of the pawl of each pawl device and covered with a polymer cushion.

5. The releasable cable holder assembly of claim 1 further comprising a cable chuck fastened to the winding wheel of the winding machine for holding the lead end of the cable to be wound, said cable chuck comprising a locating plate fixed to the winding wheel of the winding machine, a fixed jaw fixedly fastened to said locating plate, a pin fastened to a hole on said locating plate by a clamp, a movable jaw loosely coupled to said pin and moved relative to said fixed jaw, and a spring mounted around said pin to force said movable jaw toward said fixed jaw.

* * * * *